United States Patent [19]

Chartier et al.

[11] Patent Number: 4,529,096

[45] Date of Patent: Jul. 16, 1985

[54] PILFERPROOF CAP

[75] Inventors: Robert M. Chartier, Waterloo; Jean P. Richard, St. Bruno, both of Canada

[73] Assignee: Consumers Glass Company Limited, Canada

[21] Appl. No.: 676,620

[22] Filed: Dec. 4, 1984

Related U.S. Application Data

[63] Continuation of Ser. No. 385,439, Jun. 7, 1982, abandoned.

[51] Int. Cl.[3] ..... B65D 41/34

[52] U.S. Cl. ..... 215/252; 215/250

[58] Field of Search ..... 215/250, 252, 258, 272, 215/317, 318

[56] References Cited

U.S. PATENT DOCUMENTS

| | | | |
|---|---|---|---|
| 3,329,295 | 7/1967 | Fields | 215/252 |
| 3,455,478 | 7/1969 | Fields et al. | 215/252 |
| 3,463,341 | 8/1969 | Fields | 215/252 |
| 3,944,102 | 3/1976 | Grau | 215/258 |
| 4,126,240 | 11/1978 | Brach | 215/252 |
| 4,147,268 | 4/1979 | Patel et al. | 215/258 |
| 4,165,813 | 8/1979 | Babiol | 215/220 |
| 4,197,955 | 4/1980 | Luenser | 215/252 |
| 4,343,408 | 8/1982 | Csaszar | 215/258 |
| 4,348,811 | 8/1982 | Hilaire | 215/252 |
| 4,352,436 | 10/1982 | Chartier et al. | 215/252 |
| 4,461,390 | 7/1984 | Csaszar | 215/252 |
| 4,461,391 | 7/1984 | Davis | 215/252 |

FOREIGN PATENT DOCUMENTS

| | | | |
|---|---|---|---|
| 55191 | 1/1982 | European Pat. Off. | 215/252 |
| 1536459 | 6/1968 | France | 215/252 |

*Primary Examiner*—George E. Lowrance
*Assistant Examiner*—David Fidei
*Attorney, Agent, or Firm*—Finnegan, Henderson, Farabow, Garrett & Dunner

[57] ABSTRACT

A tamper indicating plastic cap for twist application to a threaded container neck comprises cap, body and a band interconnected to the cap by a plurality of bridges. Each of the bridges slopes upwardly in the direction of twist application of the cap to the container. A plurality of drive devices have co-operating abutments on the cap and band which are normally disengaged. The bridges flex as the band is snap-fitted over a bead on a threaded container shoulder in a manner which enhances the movement of the cooperating abutments towards one another as the band moves upwardly towards the cap. The abutments engage to drive the band with the cap to prevent breaking of the bridges as the band is snap-fitted over the threaded container neck. The bridges readily break when the cap is unthreaded from the container neck with the band engaged with the container bead. Such arrangement substantially facilitates the injection moulding of the cap because the band is significantly spaced from the cap underside.

29 Claims, 13 Drawing Figures

PILFERPROOF CAP

This application is a continuation of application Ser. No. 385,439, filed June 7, 1982, now abandoned.

FIELD OF THE INVENTION

This invention relates to plastic caps having a dependent band interconnected thereto by plurality of bridges for use in indicating tampering or pilfering with the container contents. The plastic cap is provided with drive devices which drive the band with the cap to snap-fit the band over the bead on a container neck as the cap is twist applied to the container.

BACKGROUND OF THE INVENTION

There is an increasing demand for the use of tamper indicating or pilferproof caps on containers; particularly in the food and beverage industry where tampering with the contents may cause spoilage and inconvenience to the consumer. Plastic caps are widely used on a variety of types of containers. Many attempts have been made at providing pilferproof features on plastic caps to clearly indicate to the consumer whether or not the container has been previously opened. An example of this type of cap is disclosed in Fields, U.S. Pat. No. 3,329,295. The band with tamper indicating feature is snap-fitted over a bead on a threaded container neck. To prevent breakage of the bridges which connect the band to the cap, a specially designed capping chuck is used which grips both the cap and the band at the same time to rotate both parts as the band is snap-fitted over the bead of the container.

Most industries are already set up for screw on type cap applications; however, with the Fields type of closure, special chucks have to be designed which require refitting of many of the existing machines at considerable expense.

Another approach to applying a pilferproof cap to a container involves a downward force to snap-fit not only the band over the bead on the container, but also the threads of the cap over the threads on the container neck. This technique is disclosed in French Pat. No. 1,536,459 to Rapeaud et al. In view of the band being directly snap-fitted over the bead on the container without any twist application, the bridges which connect the band to the cap are not over stressed so that breakage of the bridge is avoided. However, as with Fields, the Rapeaud et al design has the same problem in that substantial modification in the capping machines would be required.

French Pat. No. 1,581,775 to S. A. Albaco, discloses a pilferproof cap having a type of drive system which ensures that the band rotates with the cap, as the band is snap-fitted over a bead on the container. This protects the bridges which connect the band to the tearstrip of the pilferproof arrangement. The drive is provided in the form of closely spaced teeth and notch portions in the pilferproof band and tear part. The teeth and notches abut during cap application to rotate the band with the cap as it is snap-fitted over the container bead. A similar form of drive mechanism is disclosed in the German Offenlegungsschrift No. 1,955,047 to R. Finke. Bridges are used to interconnect the pilferproof band portion to the cap. To protect the bridges, teeth extending downwardly from the cap and upwardly from the band abut one another as the cap is applied to rotate the band with the cap in snapping the pilferproof band over a bead on a container neck. The difficulty with both of these cap designs is that the drive mechanisms are arranged so as to be close to one another or close to the cap and band portions. This results in arrangements which are difficult to mold by injection molding techniques, because narrow spacings between band and cap and the drive devices usually results in "flash" problems where the injected plastic seeps around parts of the mould to undesirably interconnect portions over the narrow spaces.

The pilferproof cap design, according to this invention, provides considerable spacing between all components of band and cap to facilitate injection molding by improved bridge designs for interconnecting the band to cap.

SUMMARY OF THE INVENTION

A screw on plastic cap with tamper indicating provision comprises a cap with depending band having an internal shoulder adapted for snap-fit engagement with a bead on a threaded container neck. A plurality of means connect the band to the cap. The connecting means may be in the form of a plurality of bridges which readily break when the cap is unscrewed from the container neck with the band shoulder engaged with a bead on the threaded container neck. A plurality of cooperating drive devices are associated with the cap and band to drive the band with the cap as it is snap-fitted over the bead on the threaded container neck, when the cap is screw applied to the container. Each of the drive devices comprises cooperating abutments on the cap and band which are normally disengaged. The abutments are spaced apart with each abutment associated with the cap having its lower portions spaced above the upper portion of the abutment associated with the band and the abutments are all spaced from the respective bridges. The bridges are sufficiently weak to readily flex as the band is applied over the bead to allow the band to move upwardly towards the cap to engage the abutments to drive the band with the cap to ensure the integrity of the bridges. The arrangement is such that sufficient spacing is provided between the cap and band in between co-operating abutments of the drive devices to facilitate moulding.

The bridges for interconnecting the band to the cap may be very thin and fragile so as to be considered as filaments. The filaments are sufficiently weak to readily sever upon unthreading the cap from the container to indicate that the container has been pilfered. The filaments are preferably obliquely oriented relative to the cap longitudinal axis to flex and readily permit the band to move towards the cap, as the band is snap-fitted over the bead on the threaded container neck. This movement engages the drive devices to drive the band with the cap to ensure the integrity of the filaments.

To encourage movement of the cooperating abutments of the drive devices towards one another as the band is moved upwardly towards the cap, the bridges may all be sloped upwardly in the direction of twist application of the cap onto the the container. The bridges readily flex as the band is snap-fitted over the bead on the container to allow movement of the band towards the cap and cooperate with the circumferential shifting of the band relative to the cap in moving the abutments towards one another so that they can readily engage and drive the band with the cap.

BRIEF DESCRIPTION OF THE DRAWINGS

Preferred embodiments of the invention are shown in the drawings wherein.

DETAILED DESCRIPTION OF THE PREFERRED EMBODIMENTS

Plastic caps for use in the container closure field are normally formed by injection molding techniques which are well understood by those skilled in that art. The cap, according to this invention, may be formed from various plastic materials which are commonly used in the injection molding of plastic caps. Preferred materials are polyethylene, polypropylene and copolymers of polyethylene and polypropylene. The caps may have integrally formed on their undersides, fins or the like for purposes of sealing with the container rim and neck portions, or the cap may be adapted for use with a liner sealer.

Figure 1:
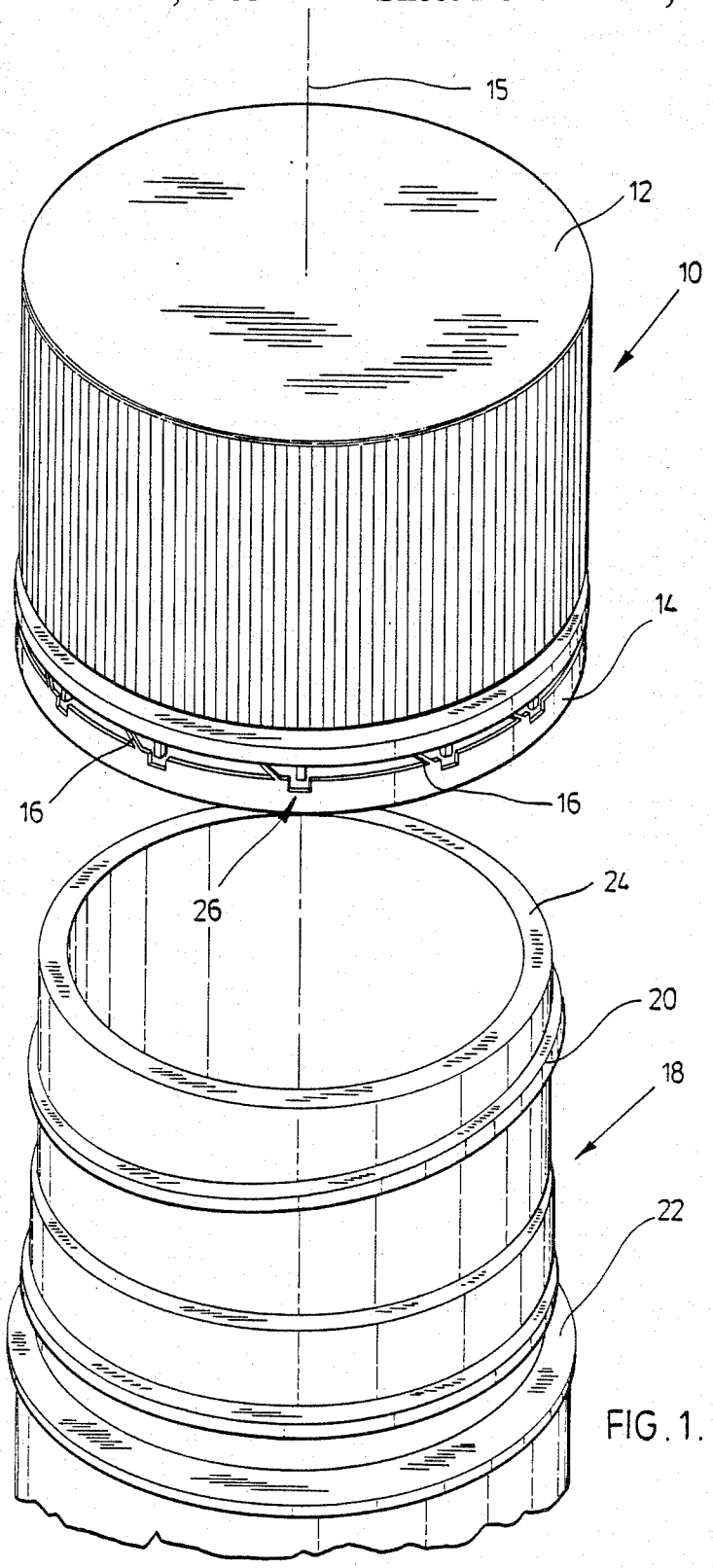
FIG. 1 is a perspective view of a pilferproof cap embodied by the invention about to be applied on the threaded container neck having the bead portion over which the pilfer proof band is snap-fitted.

Referring to FIG. 1, the cap 10, according to a preferred embodiment of the invention, comprises a cap body portion 12 with depending band 14 which are concentric about cap longitudinal axis 15. The band is interconnected to the cap by a plurality of bridges 16. The bridges are circumferentially spaced apart and according to this embodiment, the bridges are approximately evenly spaced apart. The cap 10 is adapted for twist application to a threaded container neck portion generally designated 18. Threads 10 are provided on the exterior of the container neck. Beneath the threads, is a bead 22 integrally provided on the bottle neck, where the band 14 is adapted to be snap-fitted over the bead 22 as the cap is twist applied to the container. Normally, the cap seals the container by engagement with the container rim 24 and optionally with proximate interior and exterior surfaces of the container neck. To insure integrity of the bridges 16 as the band 14 is snap-fitted over the bead 22 during twist application of the cap 10, a plurality of drive devices generally designated 26 are provided which drive the band 14 with the cap to prevent breakage of the bridges 16 as the band is snap-fitted over the bead 22.

Figure 2:
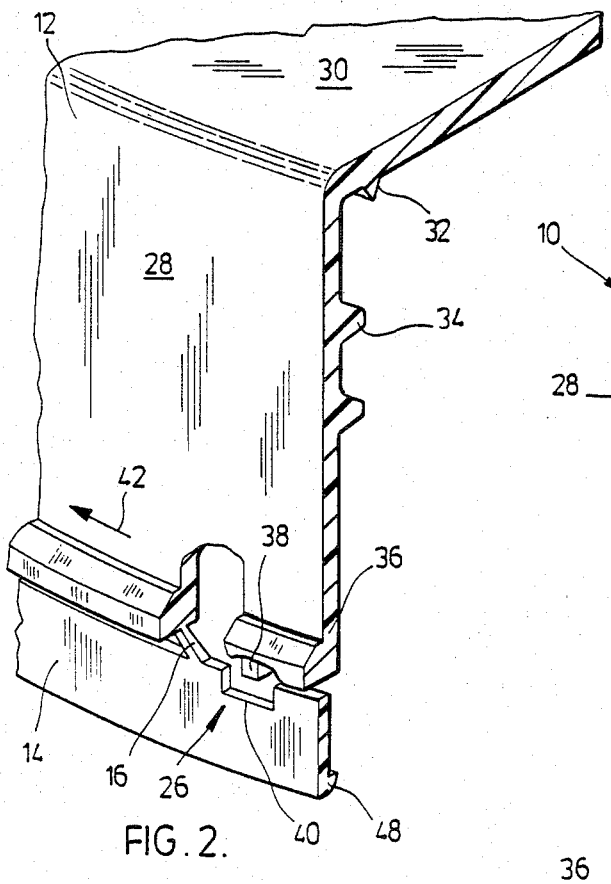
FIG. 2 is a section of the cap of FIG. 1 with portions removed to show the interconnecting bridges and the drives for rotating the band with the cap to protect the bridges as the band is snap-fitted over the bead on the container.

Turning to FIG. 2, the cap body 12 comprises a sidewall portion 28 and a top wall portion 30. On the underside of the top wall 30 an annular fin 32 is provided which is adapted to engage the container rim 24 to seal the container when the cap is firmly seated on the container neck. On the interior of sidewall 28, a thread arrangement 34 is provided which is adapted to engage and cooperate with the threads 20 of the bottle neck so that the cap may be screw applied to the bottle in accordance with standard techniques.

The bottom portion 36 of the cap sidewall 28 has a plurality of depending projections 38 extending downwardly therefrom and which form a component of the drive device 26. The other component of the drive device 26 is provided by the recess 40 in the band 14. The recess is of a width greater than the width of the cap projection 38. The band, as more clearly shown in FIG. 2, is connected to the lower portion 36 of the cap by the bridge 16 which slopes upwardly in the direction of cap twist application designated by arrow 42.

Figure 3:
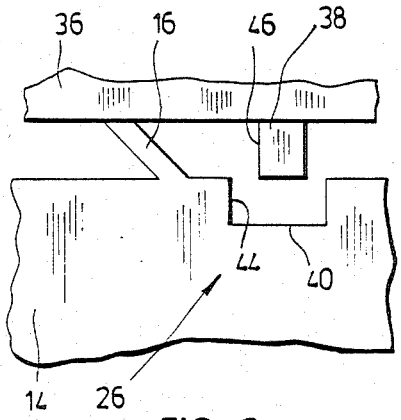
FIG. 3 is a side elevation of the bridges and drive elements of FIG. 2.

Details of the drive device 26 is shown more clearly in FIG. 3 where the recess 40 provides a vertical face 44 in the form of an upstanding projection and projection 38 provides a vertical face 46. Offset faces 44 and 46 as they oppose one another constitute the cooperating abutments of the drive device. The abutments or the operative portions of abutments 44 and 46 are vertically spaced apart, i.e. offset such that the lower portion of face 46 is slightly above or approximately in the same plane as the upper portion of face 44. As can be seen, they are normally disengaged and become engaged by movement of the band 14 towards the cap lower portion 36. The band movement occurs during twist application of the cap to the container as the band internal shoulder 48 engages the bead 22 on the container neck 18.

Figure 4:
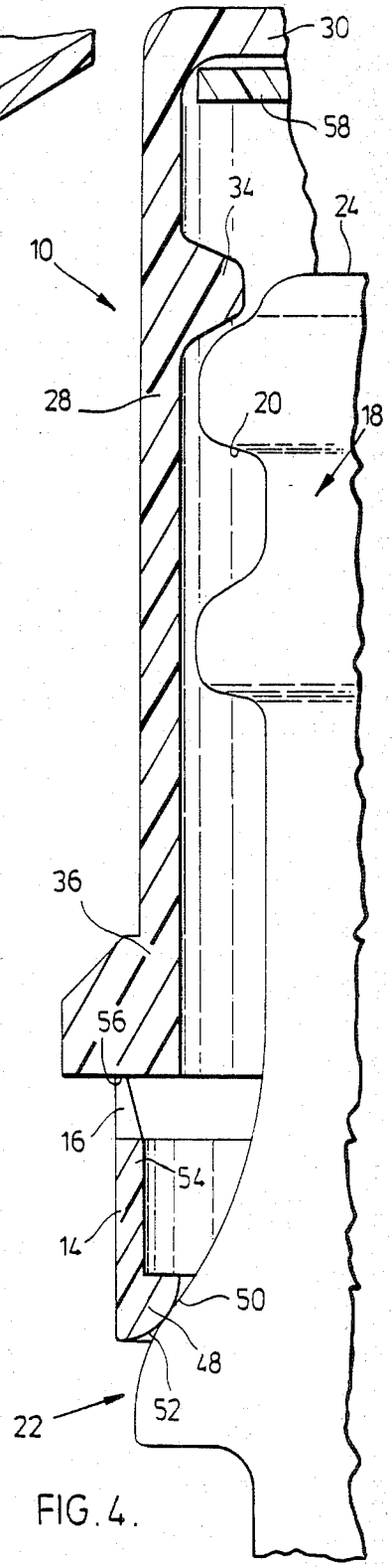
FIG. 4 is a section of a threaded container neck with the cap of FIG. 1 about to be screw threaded thereonto.

The commencement of application of the cap 10 to the container neck 18 is shown in FIG. 4, where the threads 34 on the interior surface of sidewall 28 engage the threads 20 on the container neck 18. Another common form of sealer is the liner 58 which is located beneath the top wall 30 of the cap. It is squeezed against the rim 24 of the container neck 18 to seal the container in the normal manner. With twist application, the internal shoulder 48 on the band 14 engages the lead in portion 50 on the bead 22. The internal shoulder 48 is rounded at 52 so as to cammingly engage the sloped surface 50. This assists in expanding circumferentially the band 14 as the shoulder 48 is snapped over the bead 22. Also as more clearly shown in FIG. 4, the bridge 16 is the same width as the upper portion 55 of the band 14; however, it tapers inwardly to a thiner portion at 56 where it joins the lower region 36 of the cap 10. This is to ensure that when the bridges are broken, the severance is made at the juncture 56 with the cap.

By continued screw threading of the cap onto the container, the band 14 continues to spread outwardly as the internal shoulder 48 is pushed further down the bead 22. Considerable resistance is encountered in pushing the internal shoulder 48 of the band 14 downwardly over the bead 22. In the absence of drive devices, the band shoulder in engaging the bead would lag behind the cap body 12 and due to the weakness of the bridges 16, they would break thus spoiling the pilferproof feature of the cap. To protect the bridges 16, the drive devices 26 are actuated by flexing of the bridges 16 to allow the band 14 to move towards the cap lower portion 36 to engage the abutment faces 44 and 46. With the faces engaged, the band 14 is driven with the cap in the direction of arrows 42 to ensure that the bridges 16 are not overstressed or stretched to the point of breaking. The abutment faces 44 and 46 of the drive devices are arranged relative to the bridges so as to be spaced from the bridges in a manner that abutment face 44 only abuts face 46 when the cap is screw threaded onto the container neck. It is apparent that the physical characteristics of the bridges cooperate with the drives, because the bridges have to be sufficiently weak to permit engagement of the drives. In turn, upon engagement of the drives, the bridges are protected from breakage.

Figure 6:
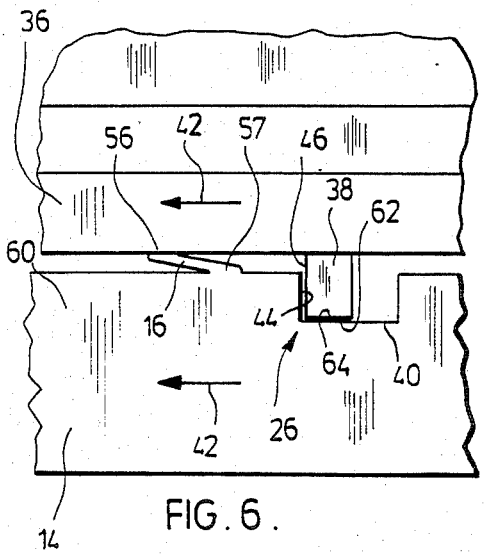
FIG. 6 shows the flexing of the bridges to engage the drives to rotate the band with the cap.

To facilitate injection moulding of the cap, the arrangement according to this invention provides considerable spacing between the band 14 and the cap 12; and between the operative faces 44, 46 of the drive device 26. The bridges are designed so as to be sufficiently flexible to allow movement of the band 14 towards the cap as the shoulder 48 of the band engages and is pushed over bead 22 of the container. As shown in FIG. 6, the bridges 16 flex principally at their junctures 56 with the cap bottom portion 36 and at 57 with the band upper portion 60. The bridge 16 in essence collapses which allows the projection 38 to move into the recess 40. Due to the upward slope of the bridge 16 relative to the direction of application, as the bridge 16 collapses the natural movement for the band 14 is in a direction opposite to arrow 42. This direction of movement enhances the movement of the operative drive faces 44 and 46 towards each other. Such flexing of the bridge 16 cooperates with the natural tendency for the band 14 to lag behind the cap 42 as it first engages the bead 22 of the container. Thus there is a natural flexing in the bridge 16 as the drive faces 44, 46 move towards one another and become engaged to commence driving the band 14 with the cap 12 to ensure that the bridges 16 are not overstressed and broken.

The bridges may have a variety of shapes to provide for the necessary flexing thereof. As per the embodiment illustrated, the bridges are in the form of thin members which could be considered as filaments to suggest the weak fragile aspect of the bridges 16.

Figure 5:
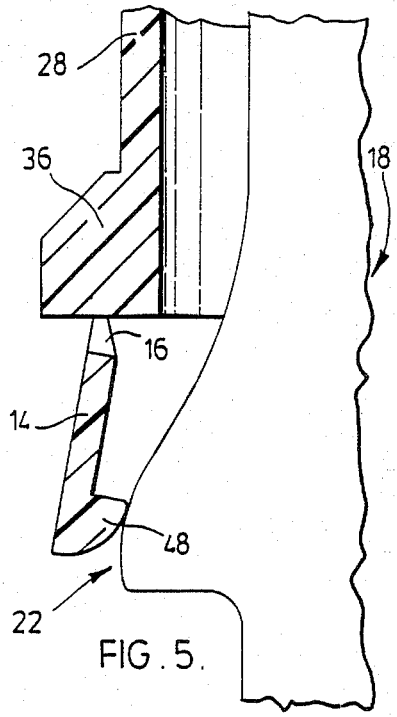
FIG. 5 shows the pilferproof band portion expanding circumferentially and being snap-fitted over the bead on the container.

With the preferred arrangement of the thin bridges or filaments 16, as shown in FIG. 6, they collapse between the upper portion of the band 14 and the lower portion 36 of the cap 12 which is also shown in the section of FIG. 5. To prevent crushing of the thin filaments 16 between the band and cap, the projection 38 is of a height greater than the depth of recess 40. The lower portion 62 of the projection 38 bottoms out on base portion 64 of the recess 40. The difference in height between the projection 38 and the recess 40 may be selected to be equal to at least the width of the filament 16 to preclude crushing of the filament between the cap and band.

Figure 7:
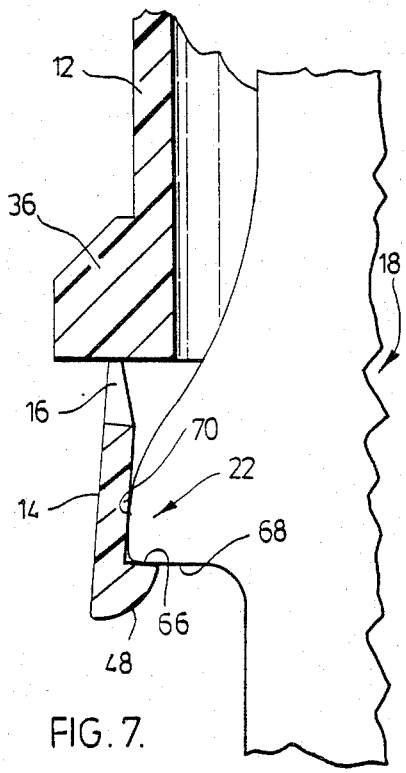
FIG. 7 shows the pilferproof band snap-fitted over the bead of the container.

With continued twist application of the cap to the container, the band 14 is forced over the bead 22 by either the projections bottoming out on the recesses or some other contact between the band and cap which exerts the downward component of force for snapping the band over the bead 22. As more clearly shown in FIG. 7, continued twist application of the cap 12 has snapped the band 14 over the bead 22. The internal shoulder 28 has a ledge 66 which abuts the underside 68 of the bead 22 to form a secure engagement of the band 14 with the bead 22. The internal portion of the band 14 above the shoulder 48 and which is designated 70 in FIG. 7, may have an internal diameter slightly less than the external diameter of the bead 22 so that the band contacts the bead after the shoulder 48 is snapped past the band 22. Depending upon tolerances there may or may not be sufficient frictional engagement between the interior surface of the band 14 and the bead 22 which may allow the band to move slightly downwardly after the band is snap fitted over the shoulder 22.

Figure 8:
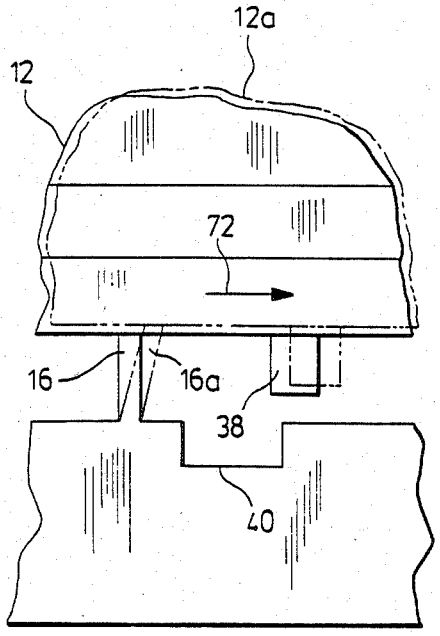
FIG. 8 shows the unthreading of the cap from the container and the stretching of the bridges.
Figure 9:
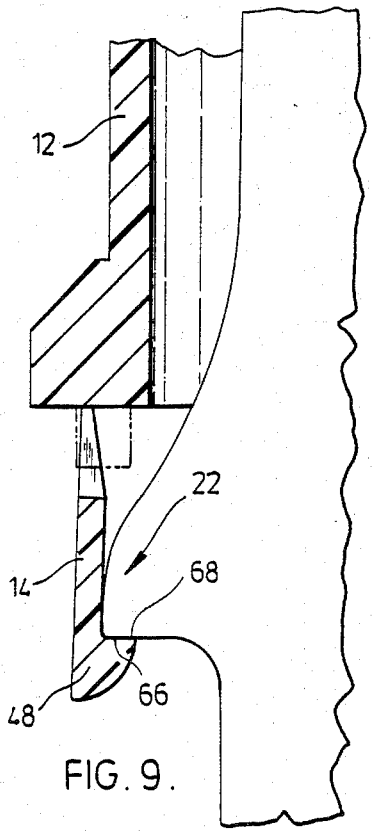
FIG. 9 shows the band as engaged with the bead on the container and the elongation of the bridges while unthreading the cap from the container.
Figure 10:
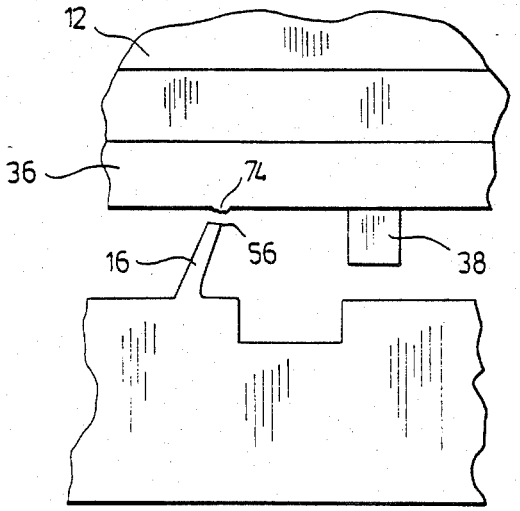
FIG. 10 shows the bridge broken with the drives disengaged in unthreading the cap from the container.

When it is desired to open the container as demonstrated in FIG. 8, the cap is rotated in the direction of arrow 72. The cap has a first position designated at 12 and a second position as shown in dot at **12*a*. The bridge 16 is extended from the position shown at 16 to the dotted position at 16*a*. While the cap is unthreaded in the direction of arrow 72 the bridge 16 continues to be distended or stretched as the ledge 66 on the shoulder 48 of the band 14 engages the underside 68 of bead 22. The snug contact between the band interior portion 70 and the bead 22 maintains the interlock between faces 66 and 68 to ensure that the band will not snap past bead 22. Thus the bridges 16 continue to be stretched as the cap 12 is unthreaded in the direction of arrow 72. With continued rotation of the cap as shown in FIG. 10, the stretched bridges 16 break at a thinner portion 56 to leave a thin nub portion 74 on the lower portion 36 of the cap 12. During this removal of the cap from the container, it can be seen that the projection 38 is clear of the recess 40** so that there is no interference of the drive device with the band in removal of the cap.

Figure 12:
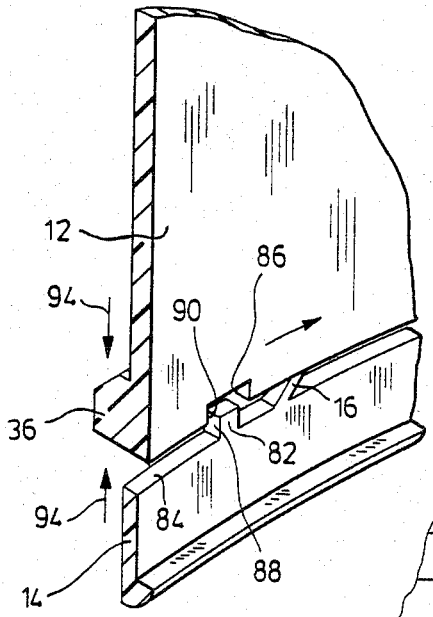
FIG. 12 shows an alternative embodiment of the invention for the drive devices.
Figure 13:
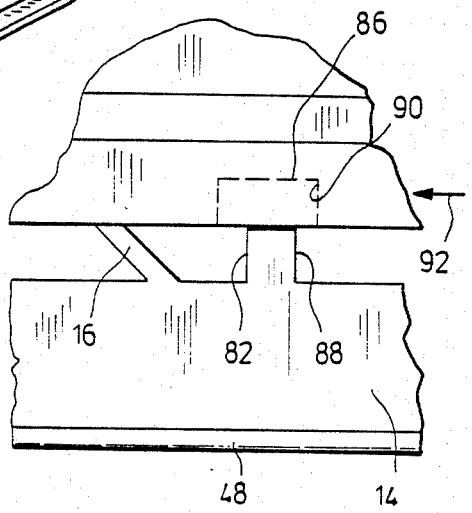
FIG. 13 is a side view of the alternative drive device shown in FIG. 12.
Figure 11:
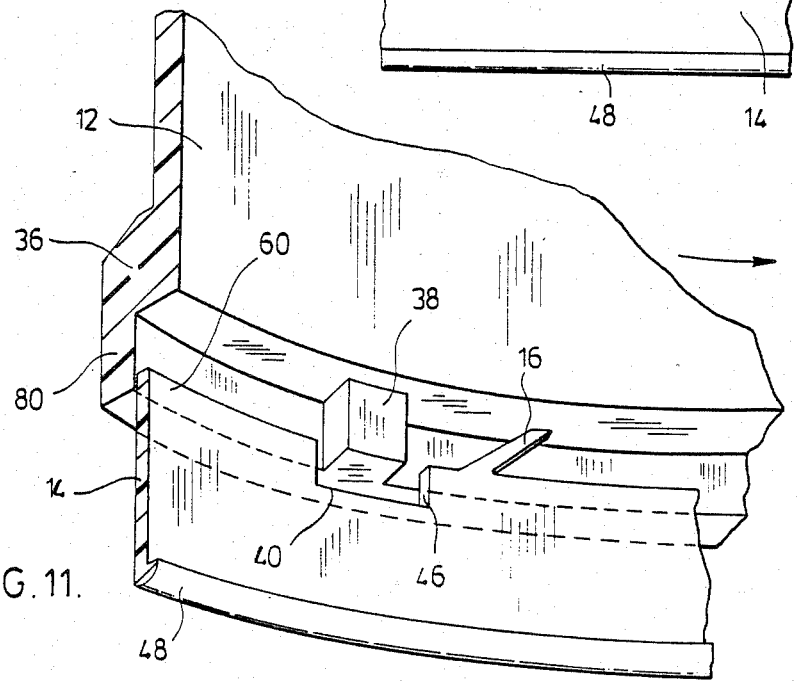
FIG. 11 shows an additional feature of the invention for housing the drive device components carried with the cap.

Depending upon the end use of the cap, as can be appreciated from FIG. 10 the projections 38 remain on the underside of the cap and may be considered unsightly or uncomfortable for the user in grasping the cap. Alternative arrangement for the drive device are shown in FIGS. 11, 12 and 13. FIG. 11 shows the cap 12 having on its lower portion 36 a depending skirt 80 which envelopes the projections 38 so that they are not exposed. The band 14 has its upper portion 60 within the skirt 80 where the bridges 16 flex, so that the operative abutment drive faces 44 and 46 may engage.

Another approach is to provide the projections of the drive devices on the band. Referring to FIG. 12, the band 14 has an upstanding projection 82 extending upwardly from its upper portion 84. The bridge 16 interconnects the band 14 to the cap 12 at the lower portion 36 of the cap 12. A recess 86 is provided in the cap whereby the operative faces of the drive device is provided by abutments 88 on projection 82 and face portion 90 of recess 86 which forms an integral projection of the cap. This relationship is shown more clearly in FIG. 13, where it can be seen that operative face portion 88 of the projection 82 will engage face 90 of recess 86 when the cap is rotated in the direction of the arrow 92. As with the other embodiments, the bridge 16 will flex and allow the band to approach the cap as demonstrated by arrows 94 to engage the offset operative faces of the drive devices. This ensures integrity of the bridges 16 as the band 14 has its shoulder portion 48 snap-fitted over the container bead.

It is apparent from the preferred embodiments of the invention that considerable spacing is provided between the band upper portion and the cap underside and between the drive components. Thus injection molding of the cap is facilitated where flashing is minimized because of the considerable space now provided. This is, of course, accomplished by the particular drive mechanism of this invention where the operative faces are vertically spaced apart and by way of appropriate flexible interconnecting bridges, the operative faces becomes engaged by movement of the band towards the cap as the band begins to be snap-fitted over the container bead.

The preferred arrangement for the bridges is that all the bridges sloped upwardly relative to the direction of application of the cap to provide parallelogram-type linkages. The bridges or filaments flex at their junctures with the band and cap to allow a circumferential shift of the band relative to the cap which cooperates with the band tending to lag behind the cap as it is applied. This action moves the operative faces of the drive devices towards one another, so that they engage before the bridges are overstressed. Although single bridges are shown in the preferred embodiment of the invention, it is appreciated that other bridge arrangements are possible which are inclined in some other manner relative to the longitudinal axis of the cap. This inclination of the bridges provides ready flexing of the bridges in allowing movement of the band towards the cap.

The cap, according to this invention, is particularly suited for application to large mouth jars, such as food jars and the like. The positive drives for protecting the bridges ensure that the band, with larger internal shoulder, is snapped over the bead on the jar. This is beneficial when the jars are of glass because of the large variation in dimensions of the bead diameter on the larger glass jars. In addition, the positive form of drives are particularly suited for high speed twist cap application, for example, twist applications at speeds in excess of 240 rpm.

Although various preferred embodiments of the invention have been described herein in detail, it will be appreciated by those skilled in the art that variations may be made thereto without departing from the spirit of the invention or the scope of the appended claims.

The embodiments of the invention in which an exclusive property or previlege is claimes are defined as follows:

1. A screw on plastic cap with tamper indicating provision comprising a cap with depending band having an internal shoulder adapted for snap fit engagement with a bead on a threaded container neck, a plurality of means for connecting said band to said cap, said connecting means readily breaking when said cap is unscrewed from a container neck with said band shoulder engaged with a bead on a threaded container neck, a plurality of co-operating drive devices associated with said cap and band to drive said band with said cap as said band is snap-fitted over a bead on a threaded container neck when said cap is screw applied thereto, said drive device associated with said cap comprising a depending projection and said drive device associated with said band comprising an upstanding projection defined by a recess in said band where said recess beneath said cap projection is of a width at least greater than the width of said cap projection, said depending projection and said upstanding projection having offset and opposing faces for engaging one another, said depending projection having its lower portion spaced above the upper portion of said upstanding projection, said connecting means being sufficiently weak to readily flex as said band is snap-fitted over a bead on a threaded container neck by screwing said cap onto such container to allow said band to move upwardly towards said cap to engage said offset faces of said depending and upstanding projections to drive thereby said band with said cap to ensure integrity of said connecting means during cap application to a corresponding container; said face on each said cap depending projection only abuts said face on each said band upstanding projection when said cap is screw threaded onto a threaded container neck, said arrangement being such that sufficient spacing is provided between said cap and band and between cooperating faces of said drive device projections to facilitate injection molding of the cap.

2. A screw on plastic cap of claim 1, wherein said plurality of connecting means are bridges.

3. A screw on plstic cap of claim 2, wherein each of said abutments in said cap project downwardly therefrom, each of said abutments in said band is defined by a recess in said band, said cap abutments moving into said band recesses to contact said band abutments as said band is snap-fitted over a bead on a threaded container neck during screw applications of said cap.

4. A screw on plastic cap of claim 2, wherein each of said abutments on said cap is defined by a recess in said cap, each of said abutments. on said band projecting upwardly therefrom, said band abutments moving into said cap recesses to contact said cap abutments as said band is snap-fitted on a bead on a threaded container neck during screw application of said cap.

5. A screw on plastic cap of claim 3 or 4, wherein each of said recesses is of a depth less than the height dimensions of each of said projections, said projections contacting the bottoms of said recesses in limiting the extent to which said band moves towards said cap to preclude damaging said bridges as they flex.

6. A screw on plastic cap of claim 3 or 4, wherein the upper portion of said band is normally in the same place as or slightly below the lower ends of said cap projections.

7. A screw on plastic cap of claim 4, wherein the lower portion of said cap is in the same plane as or slightly above the upper ends of said band projections.

8. A screw on plastic cap of claim 2, wherein said bridges all slope upwardly in a direction from the band towards the cap relative to the longitudinal axis of said cap to initiate flexing of said bridges in permitting said band to move toward said cap to engage said drive abutments.

9. A screw on plastic cap of claim 8, wherein said bridges slope upwardly in the direction of twist application of said cap onto a threaded container neck.

10. A screw on plastic cap of claim 9, wherein said bridges define a plurality of paralelogram-like linkages between said cap and band, said band shifting circumferentially relative to said cap as the bridges flex, said co-operating abutments being circumferentially spaced apart and contacting one another as said bridges flex.

11. A screw on plastic cap of claim 3, 4 or 10, wherein said cap is molded from a plastic selected from the group consisting of polyethylene, polypropylene, and a co-polymer of polyethylene and polypropylene.

12. A screw on plastic cap of claim 3, 4 or 10, wherein said band has an internal diameter above said shoulder which is approximately equal to the anticipated minimum diameter of the portion of such bead on a container which is contacted by said band internal portion after said band is snap-fitted over such container bead.

13. A pilferproof plastic cap having a cap body and a depending band for twist application to a threaded container neck having a bead over which said band is adapted to snap-fit and be retained thereby should said cap body be removed from the container, said cap body and band being axially spaced and interconnected by a plurality of bridges which are sufficiently weak to readily sever upon unthreading said cap from said container to indicate that such cap has been pilfered, drive means for transmitting rotation in the direction of twist application of said cap body to said band, sad drive means being independent of said bridges and being normally disengaged by the axial spacing between said cap body and band, said cap prior to application to a threaded container neck having said bridges obliquely sloping upwardly from said band towards said cap in the direction of twist application; during the twist application of said cap onto a threaded container neck, said bridges flex at least in the area of their junctures with said cap and said band permitting said band to move towards said cap as said band is snap-fitted over a bead of such container, said movement engaging said drive means to drive said band with said cap to ensure the integrity of said bridges.

14. A pilferproof cap of claim 13, wherein said bridges are spaced apart to define a plurality of parallelogram-like arrangements for connecting said band to said cap.

15. A pilferproof cap of claim 14, wherein said bridges are evenly spaced apart.

16. A pilferproof cap of claim 13, wherein said drive means comprises co-operating operative portions on said cap and band which are axially spaced apart, said bridges flexing as said band moves towards said cap allowing said operative portions of said drive means to move axially towards one another and engage to drive said band with said cap as the band is snap-fitted over a bead on a threaded container neck.

17. A pilferproof cap of claim 16, wherein said operative portions are co-operating abutments provided on said cap and band.

18. A pilferproof cap of claim 17, wherein said bridges as they flex during cap application enhance a component of circumferential movement of said band relative to said cap, and wherein said cap co-operating abutments are circumferentially spaced apart and said flexing of said bridges move said abutment circumferentially towards one another to facilitate their engagement for driving the band with the cap.

19. A pilferproof cap of claim 13, wherein said bridges flex at their junctures with said cap and said band to permit movement of said band towards said cap and simultaneously effect a circumferentially lateral movement between said cap and said band, and wherein said cap includes stop means for limiting relative axial movement between said cap and band and preventing crushing of said flexed bridges between the upper portion of said band and the lower portion of said cap.

20. A pilferproof cap of claim 13, wherein said band has an internal shoulder portion adapted for snap-fitting over a bead on a threaded container neck, said band having an internal diameter above said shoulder which is approximately equal to the portion of such bead on a container which is contacted by said band internal portion after said band is snap-fitted over such container bead.

21. A pilferproof cap of claim 13, wherein said cap is molded from a plastic selected from the group consisting of polyethylene, polypropylene and co-polymers thereof.

22. A pilferproof cap of claim 13, wherein said bridges flex at their junctures with said cap and said band as said band moves towards said cap, such flexing of the filaments being facilitated by the retarded rotational movement of the band relative to the cap as the band engages a bead on a threaded container neck.

23. A pilferproof cap of claim 13, wherein said bridges flex in a manner encouraged by said band tending to lag behind said cap as said cap is twist applied to a threaded container neck with a band initially contacting a bead on said container until said abutments of said drive devices engage.

24. A pilferproof cap of claim 13, wherein each said bridges has a thinner portion connected to said cap and a thicker portion connected to said band.

25. A pilferproof cap of claim 13, wherein said bridges as they flex in allowing said band to move towards said cap to engage said drive devices, assist in maintaining said band concentric with said cap to ensure engagement of said drive devices between cap and band.

26. A screw on plastic cap with tamper indicating provision comprising a cap with depending band having an internal shoulder adapted for snap fit engagement with a bead on a threaded container neck, a plurality of means for connecting said band to said cap said connecting means readily breaking when said cap is unscrewed from a container neck with said band shoulder engaged with a bead on a threaded container neck, a plurality of cooperating drive devices associated with said cap and band to drive said band with said cap as said band is snap-fitted over a bead on a threaded container neck when said cap is screw applied thereto, said drive device associated with said band comprising an upstanding projection and said drive device associated with said cap comprising an internal projection defined by a recess in said cap where said recess above said band projection is of a width at least greater than the width of said band projection, said upstanding projection and said internal projection having offset and opposing faces for engaging one another, said internal projection having its lower portion spaced above the upper portion of said upstanding projection, said connecting means being sufficiently weak to readily flex as said band is snap-fitted over a bead on a threaded container neck by screwing said cap onto such container to allow said band to move upwardly towards said cap to engage said offset faces of said internal and upstanding projection to drive thereby said band with said cap to ensure integrity of said connecting means during cap applicaton to a corresponding container; said face on each said cap internal projection only abuts said face on each said band upstanding projection when said cap is screwed onto a threaded container neck, said arrangement being such that sufficient spacing is provided between said cap and band and between cooperating abutments of said drive devices to facilitate injection molding of the cap.

27. A pilferproof plastic cap having a cap body and a depending band for twist application to a threaded container neck having a bead over which said band is adapted for snap-fit and be retained thereby should said cap body be removed from the container, said cap body and band being interconnected by a plurality of bridges which are sufficiently weak to readily sever upon unthreading said cap from said container to indicate that such container has been pilfered, a plurality of drive devices associated with said cap body and band which are normally disengaged and are spaced from said bridges, said cap prior to application to a threaded container neck having said bridges oriented obliquely in sloping upwardly from said band towards said cap in the direction of twist application of said cap onto a threaded container neck relative to said cap longitudinal axis; during the twist application of said cap onto a threaded container neck, said bridges flex at least in the area of their juncture with said cap and said band permitting said band to move towards said cap as said band is snap-fitted over a bead of such container, said movement engaging said drive devices to drive said band with said cap to ensure the integrity of said bridges, a stop means being provided to limit the extent to which said band moves towards said cap, said stop means preventing overstressing of said bridges as they flex, said drive devices comprising a plurality of projections extending downwardly from said cap and cooperating recesses in said band below said projections, said projections and recesses providing faces which abut to drive said band with said cap during twist application, said projections having end portions and said recesses having base portions, said top means comprising said projection end portions and said recess base portions where said projections are of a height greater than the depth of said recesses, said projection end portions contacting said recess bottoms to limit the extent of movement of said band towards said cap.

28. A pilferproof plastic cap having a cap body and a depending band for twist application to a threaded container neck having a bead over which said band is adapted for snap-fit and be retained thereby should said cap body be removed from the container, said cap body and band being interconnected by a plurality of bridges which are sufficiently weak to readily sever upon unthreading said cap from said container to indicate that such container has been pilfered, a plurality of drive devices associated with said cap body and band which are normally disengaged and are spaced from said bridges, said cap prior to application to a threaded container neck having said bridges oriented obliquely in sloping upwardly from said band towards said cap in the direction of twist application of said cap onto a threaded container neck relative to said cap longitudinal axis; during the twist application of said cap onto a threaded container neck, said bridges flex at least in the area of their juncture with said cap and said band permitting said band to move towards said cap as said band is snap-fitted over a bead of such container, said movement engaging said drive devices to drive said band with said cap to ensure the integrity of said bridges, a stop means being provided to limit the extent to which said band moves towards said cap, said stop means preventing overstressing of said bridges as they flex, said drive devices comprising a plurality of projections extending upwardly from said band and cooperating recesses in said cap above said projections, said projections and recesses providing faces which abut to drive said band with said cap during twist application, said projections having end portions and said recesses having base portions, said stop means comprising said projection end portions and said recess base portions where said projections are of a height greater than the depth of said recesses, said projection end portions contacting said recess bottoms to limit the extent of movement of said band towards said cap.

29. A pilferproof cap of claim 28, wherein said cap is molded from a plastic selected from the group consisting of polyethylene, polypropylene and copolymers thereof.

* * * * *